United States Patent [19]

Harada

[11] Patent Number: 4,833,367

[45] Date of Patent: May 23, 1989

[54] MAGNETRON WITH RESONANT CHOKE STRUCTURE FOR SUPRESSING UNWANTED HARMONICS

[75] Inventor: Akikazu Harada, Mobara, Japan

[73] Assignee: Hitachi, Ltd., Tokyo, Japan

[21] Appl. No.: 119,490

[22] Filed: Nov. 12, 1987

[30] Foreign Application Priority Data

Nov. 21, 1986 [JP] Japan ..... 61-276502
Apr. 20, 1987 [JP] Japan ..... 62-95137

[51] Int. Cl.[4] ..... H01J 23/32
[52] U.S. Cl. ..... 315/39.53; 315/39.51; 315/85; 331/91
[58] Field of Search ..... 315/39.53, 39.75, 39.77, 315/85; 331/91

[56] References Cited

U.S. PATENT DOCUMENTS 4,371,848 2/1983 Gotjé et al. ..... 331/91
4,459,563 7/1984 Hawaguchi ..... 315/39.53

FOREIGN PATENT DOCUMENTS 0205316 12/1986 European Pat. Off. ..... 315/39.51
54-125564 8/1979 Japan .

*Primary Examiner*—Palmer C. DeMeo
*Assistant Examiner*—Mark R. Powell
*Attorney, Agent, or Firm*—Antonelli, Terry & Wands

[57] ABSTRACT

A magnetron comprises an anode cylinder, vanes extending radially and inwardly from the anode cylinder, an output-side-sealing metal cylinder sealed to the end of the anode cylinder, an antenna lead connected to one of said vanes and a plurality of flanged metal cylinders enclosing the antenna lead and disposed inside the output-side-sealing metal cylinder along the direction of a magnetron tube axis.

9 Claims, 12 Drawing Sheets

MAGNETRON WITH RESONANT CHOKE STRUCTURE FOR SUPRESSING UNWANTED HARMONICS

BACKGROUND OF THE INVENTION

The present invention relates to a magnetron, and more particularly to an improved filter structure for preventing leakage of undesired electromagnetic waves of certain wavelengths generated by the magnetron such as harmonics.

In conventional magnetrons there was provided a filter structure, what is called a choke structure, comprising a space formed by a wall of an output-side-sealing metal cylinder the lower end of which is hermetically sealed and electrically connected to the upper end of an anode cylinder, the upper end of which is hermetically sealed to an insulating cylinder, which is concentric with the axis of the magnetron tube and through which a lead for an antenna passes, and a wall of a metal cylinder disposed inside the output-side-sealing metal cylinder, the open end of the space facing the anode of the magnetron as described in Japanese Utility Model Application Laid-open Publication No. 54-125564, for example. FIG. 1 illustrates one example in which there is a cylinder 30 forming a choke structure positioned inside output-side-sealing cylinders 20 and 21 which provides desired fitering characteristics by optimum design of dimensions D to H shown in FIG. 1, D being chosen to be about a quarter of a wavelength to be suppressed, but its prevention of leakage of undesired electromagnetic waves has been unsatisfactory.

In assembling the antenna structure of a magnetron with a conventional choke structure by brazing output-sidesealing metal cylinders 20, 21, a choke-forming metal cylinder 30, an insulator 9, a metal cylinder 10 and an exhaust tube, there were needed jigs for positioning these components from the outside of them as well as jigs inserted into the inside of these components for positioning from the inside of the components. Therefore when using thin washer-shaped Ag-Cu solder for example, positioning jigs placed on the outside of the components sometimes bend the thin washer-shaped Ag-Cu solder interposed between the components without locating the solder into a proper position, resulting in defective brazing and low manufacturing yield rate. In order to solve this problem, an excessive amount of solder was needed. And jigs for positioning from both the outside and the inside of the components were expensive.

SUMMARY OF THE INVENTION

It is an object of the present invention to provide an improved choke structure for a magnetron to prevent leakage of noise electromagnetic waves more effectively than conventional ones.

It is another object of the present invention to provide a low cost choke structure for a magnetron which facilitates positioning its components in the fabrication process, resulting in a higher manufacturing yield rate.

The above objects, in accordance with the present invention, can be attained by disposing a plurality of flanged metal cylinders enclosing an antenna lead connected to a vane in a magnetron body inside an output-side-sealing cylinder enclosing the antenna lead and being kept at the same potential as the anode and by making spaces enclosed by the output-side-sealing cylinder and respective flanged cylinders parallel resonant with particular wavelengths to be suppressed. Each of the spaces provides a large impedance for a particular resonant frequency and the output voltage of the particular resonant frequency is very small compared with the voltage across the impedance formed by the space, resulting in suppression of leakage of the particular resonant wavelength from the magnetron.

In accordance with another preferred embodiment of the present invention, there is provided a choke structure wherein an output-side-sealing cylinder is divided into a plurality of sub-cylinders stacked along the direction of the magnetron tube axis by hermetically sealing.

In this embodiment an end of a choke-forming cylinder can be positioned outside the output-side-sealing cylinder, thereby facilitating positioning the choke-forming cylinders in their intended mutual relationship in a jig and locating a solder in a proper position in a brazing process and inspecting brazed portions. Precise brazing for hermetic sealing can be realized, resulting in high manufacturing yield rate and reduction of cost of a magnetron tube. And a stepped portion between different diameters of a choke-forming cylinder also facilitates positioning and centering a plurality of cylinders.

DETAILED DESCRIPTION OF PREFERRED EMBODIMENTS

Generally, a filter circuit can be formed by placing a resonant circuit composed of a resonant cavity in a microwave transmission line. A choke structure having a length of a quarter of a wavelength to be suppressed and formed in a coaxial cable suppresses transmission of the wavelength. That is because an impedance as viewed from the open end of a choke into the inside of the choke is theoretically infinity for that particular wavelength, and therefore an impedance as viewed from the open end of a choke into a load can be negligibly small and the voltage across the load can be substantially zero. It is important for a magnetron to have a resonant cavity at its output portion for suppression of leakage of an undesired wavelength.

When the diameter of an output-side-sealing cylinder is 6 to 8 times larger than that of an antenna lead such as the output of a magnetron, the length of a choke-forming cylinder must be modified to be shorter than a quarter of a wavelength to be suppressed because a metal portion adjacent to the open end of a choke must be taken into consideration.

Figure 1:
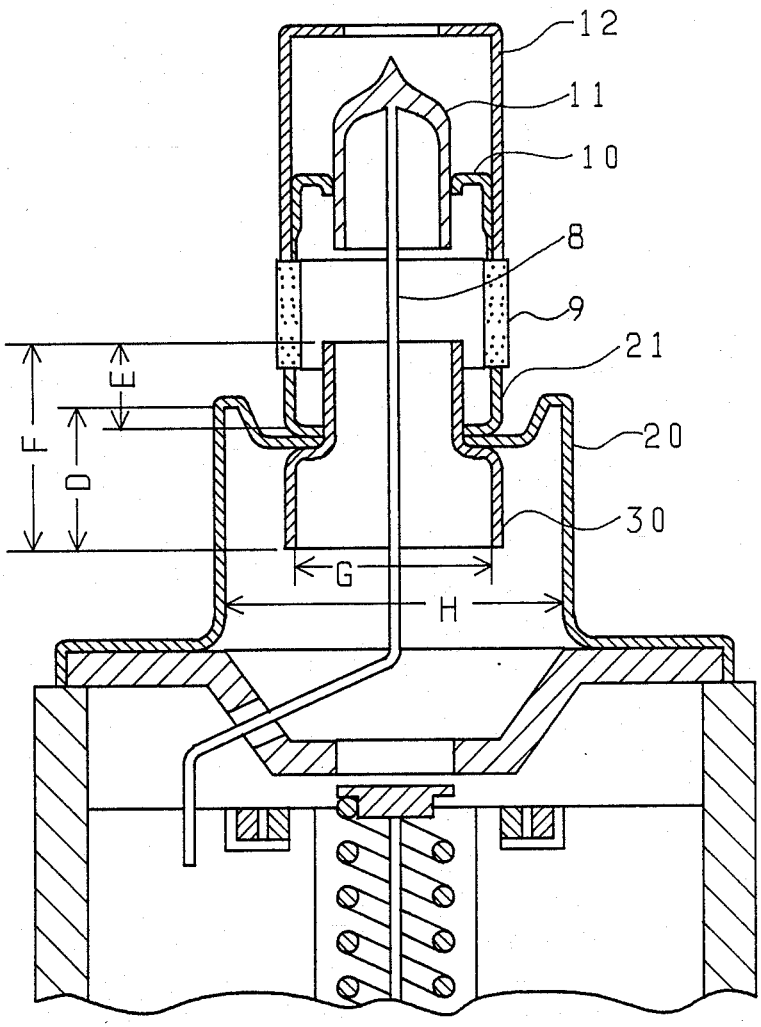
FIG. 1 PRIOR ART
FIG. 1 is a cross-sectional view of a conventional magnetron.
Figure 2:
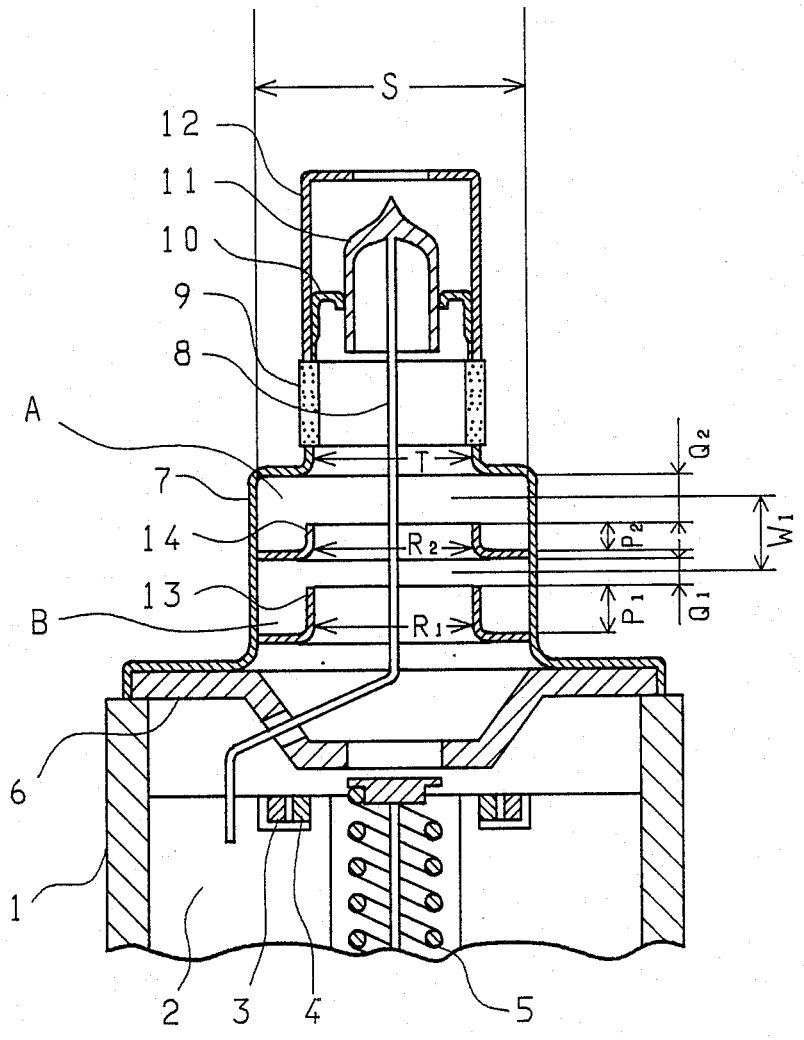
FIGS. 2, 4, 5, 7, 9, 10, 11 and 12 are a cross-sectional view of embodiments of the present invention.

In FIG. 2 numeral 1 indicates a cylindrical anode, and are 2 vanes extending radially and inwardly and fixed inside the anode 1. Numerals 3 and 4 indicate strap rings for electrically connecting alternate vanes 2 to one another and for keeping them at the same potential, respectively. Anode 1, vanes 2, and strap rings 3, 4 form a resonant anode cavity. Numeral 5 indicates a cathode for emitting thermionic electrons, 6 pole pieces for converging magnetic fluxes from permanent magnets (not shown), and 7 an output-side-sealing cylinder for hermetically sealing an anode 1 and an insulating cylinder 9. Numeral 8 indicates an antenna lead for transferring microwave energy stored in a resonant anode cavity to an and antenna, 11 an exhaust tube for evacuating a magnetron tube and having been sealed off and tipped off after evacuation of the tube. Numeral 10 indicates a sealing member for hermetically sealing an insulating cylinder 9 and an exhaust tube 11. Numeral 12 indicates an antenna cap for adjusting the height of an antenna. Numerals 13 and 14 indicate flanged cylinders in accordance with the present inventin being brazed with solder, for example to the inside of the output-side-sealing cylinder 7 with their flanges facing the resonant anode cavity and with the open ends of their cylinder facing the output side of the magnetron tube. Each of the spaces A and B as shown in FIG. 2 formed by the flanged cylinders 13, 14 and the output-side-sealing cylinder 7 is made resonant with each wavelength to be suppressed by optimizing the dimensions P, Q, R and W shown in FIG. 2. For a particular undesired wavelength to be suppressed (for example, harmonics), the impedance of a choke is very high due to parallel resonance, so that radiation of the undesired wavelength is decreased extremely.

Specific dimensions for an embodiment are as follows, $P_1=5$ mm, $P_2=5$ mm, $R_1=9$ mm, $R_2=9$ mm, $Q_1=3$ mm, $Q_2=3$ mm, $W_1=6$ mm, $S=19$ mm, $T=9$ mm.

Figure 3:
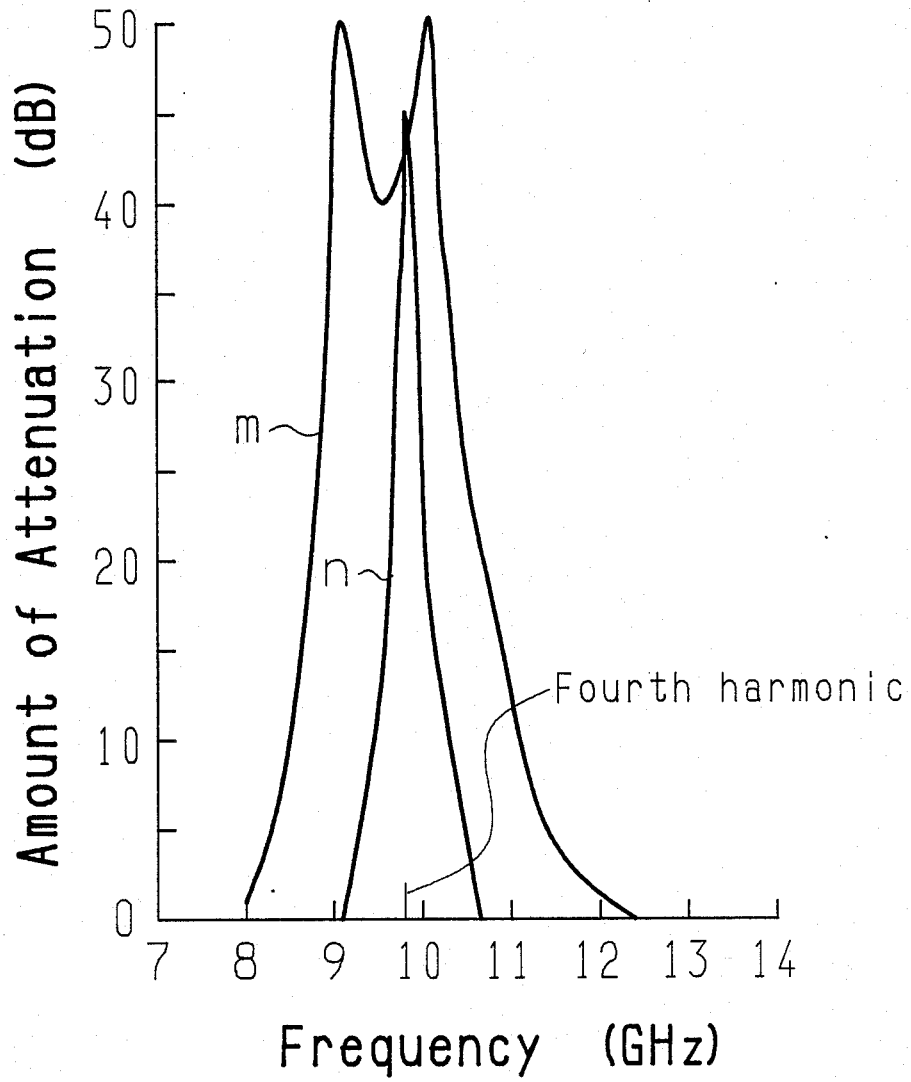
FIGS. 3, 6, and 8 are graphs showing an amount of attenuation vs. frequency in the embodiments of the present invention.

In FIG. 3 the attenuation in transmission in case of two flanged cylinders 13, 14 being used is indicated by the curve m in comparison with the case of a single flanged cylinder being used indicated by the curve n. The bandwidth of attenuation at 30 dB for two flanged cylinders is more than ten times that for a single flanged cylinder.

When the dimensions $P_1$ and $P_2$ of flanged cylinders 13, 14 have the same value, suppression effect for that resonant wavelength is greater, and when the dimensions $P_1$ and $P_2$ have different values, the spaces formed by the two flanged cylinders have suppression effects for different wavelengths.

Figure 4:
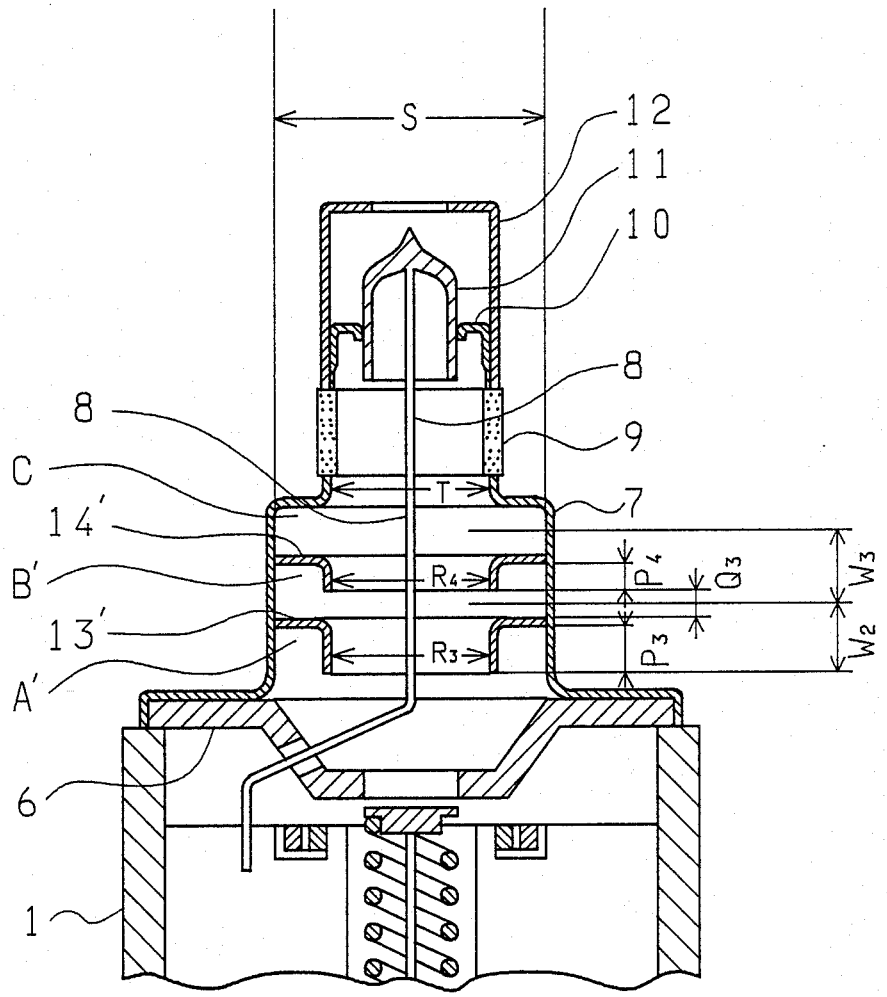

FIG. 4 shows another embodiment in accordance with the present invention. Flanged cylinders 13' and 14' are fixed to the inside of the output-side-sealing cylinder with their flanges facing the output side of the magnetron tube, and with the open ends of their cylinder facing the resonant anode cavity. Three spaces A', B' and C formed by two flanged cylinders 13', 14' and output-side-sealing cylinder 7 can be made resonant with three different wavelengths to be suppressed by optimizing dimensions P, Q, R and W, resulting in a choke structure providing large attenuation in wide bandwidth.

Figure 5:
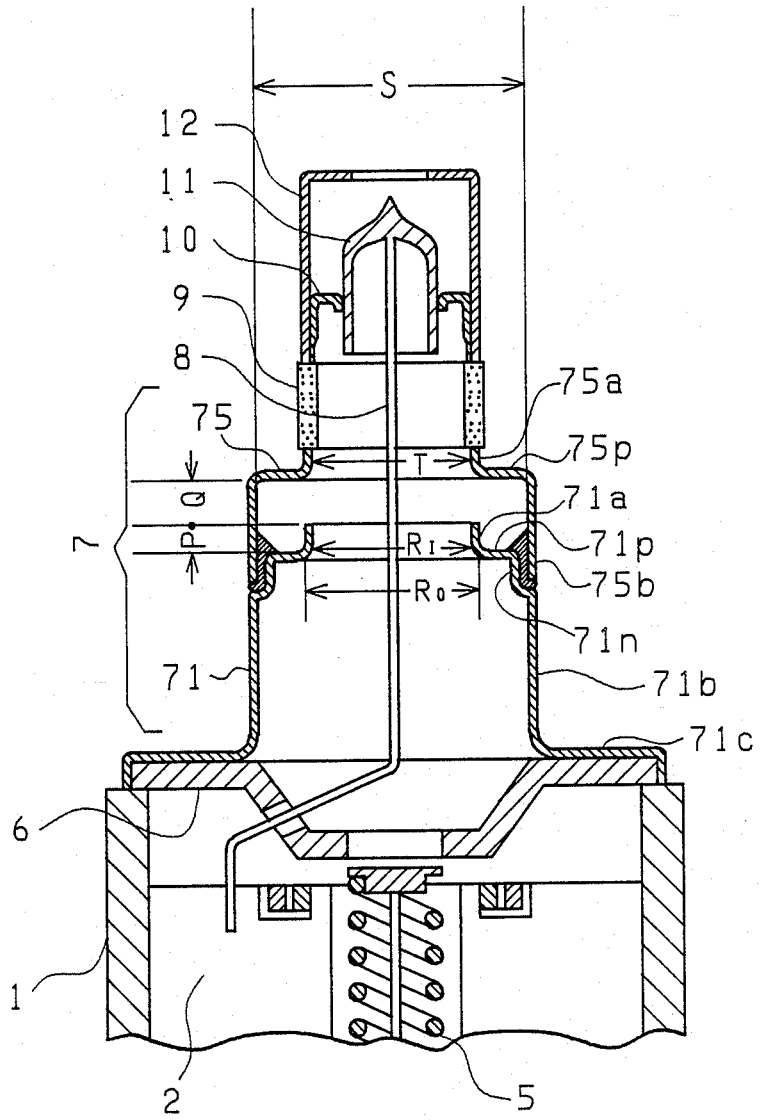
Figure 6:
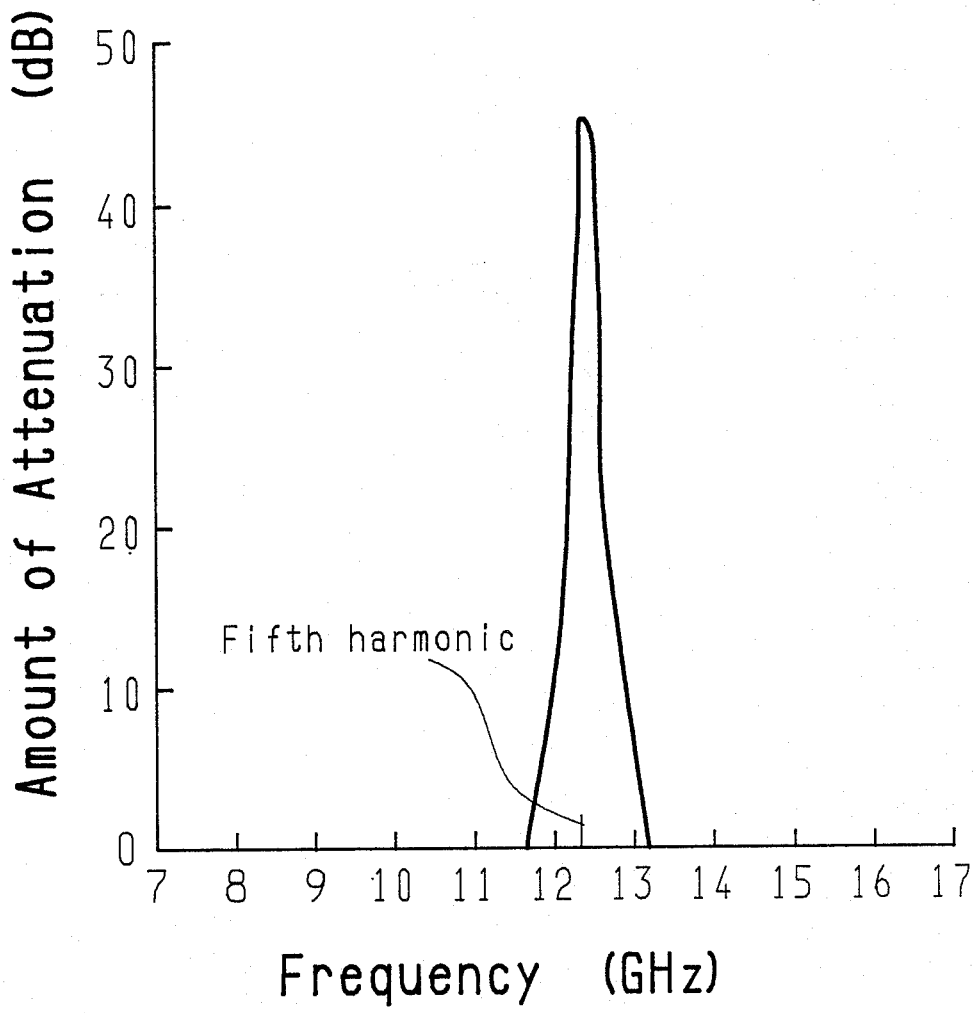

FIG. 5 shows another preferred embodiment of the present invention. Numeral 7 indicates an output-side-sealing cylinder which is divided into two sub-cylinders 71 and 75. The sub-cylinder 71 comprises a cylinder portion 71*a*, a flange portion 71*p*, a stepped portion 71*n*, a cylinder portion 71*b* and a flange portion 71*c*, and the sub-cylinder 75 comprises a cylinder portion 75*a*, a stepped portion 75*p*, and a cylinder portion 75*b*. The sub-cylinder 71 is hermetically sealed to the anode 1 at the flange portion 71*c*. The subcylinders 71 and 75 can be positioned in their intended mutual relationship by inserting the stepped portion 71*n* into the end of the cylinder portion 75 without using a jig, and then are hermetically sealed by brazing with Ag-Cu solder ring 15. The sub-cylinder 75 is hermetically sealed to the insulating cylinder 9 at the end of the cylinder portion 75*a*. The cylinder portion 71*a* is extending into the cylinder portion 75*b* and forms a choke-forming space which functions as a filter together with a flange portion 71*p*, the cylinder portion 75*b* and the stepped portion 75*p*. By making the choke-forming space parallel resonant with a particular wavelength to be suppressed, that is, by making an impedance as viewed from the end of the cylinder portion 71*a* into the chokeforming space maximum at the particular wavelength, with optimization of dimensions $R_I$, $R_O$, P, Q, S and T, leakage of an electromagnetic wave of a wavelength to be suppressed can be minimized. FIG. 6 shows a choke structure of an embodiment in accordance with the present invention can suppress greatly the transmission of the fifth harmonic, 12.25 GHz from a magnetron when $T=9.0$ mm, $S=19.0$ mm, $Q=3.2$ mm, $P=2.5$ mm, $R_O=10.5$ mm and $R_I=9.5$ mm.

Figure 7:
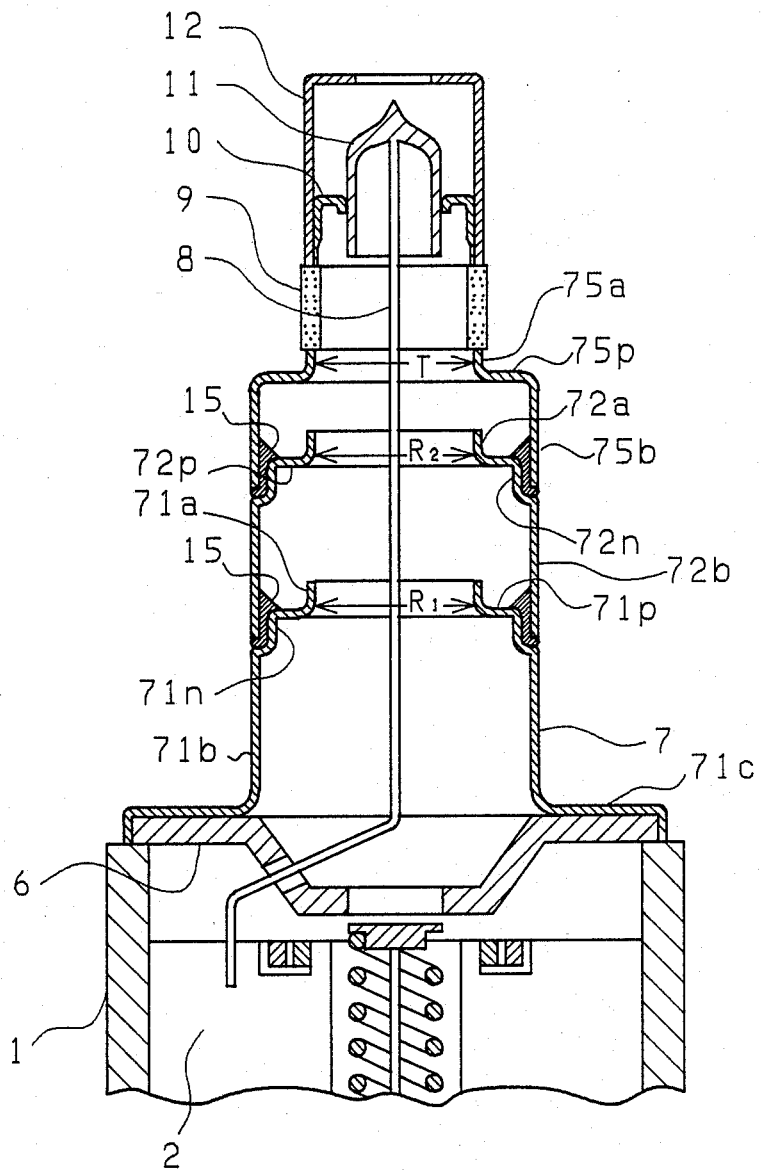

FIG. 7 shows another embodiment wherein the outputside-sealing cylinder is divided into three sub-cylinders 71, 72, and 75 which are hermetically sealed at the stepped portions 71*n* and 72*n* by brazing with Ag-Cu solders 15. In FIG. 7 same numerals are used to designate the same parts or portions as in FIGS. 1, 2, 4 and 5. There are no limitations on the diameters $R_1$ and $R_2$ because this choke structure does not require inserting any jigs into the inside of the output-side-sealing cylinder when they are positioned for brazing except for a jig for positioning an exhaust tube 11.

Figure 8:
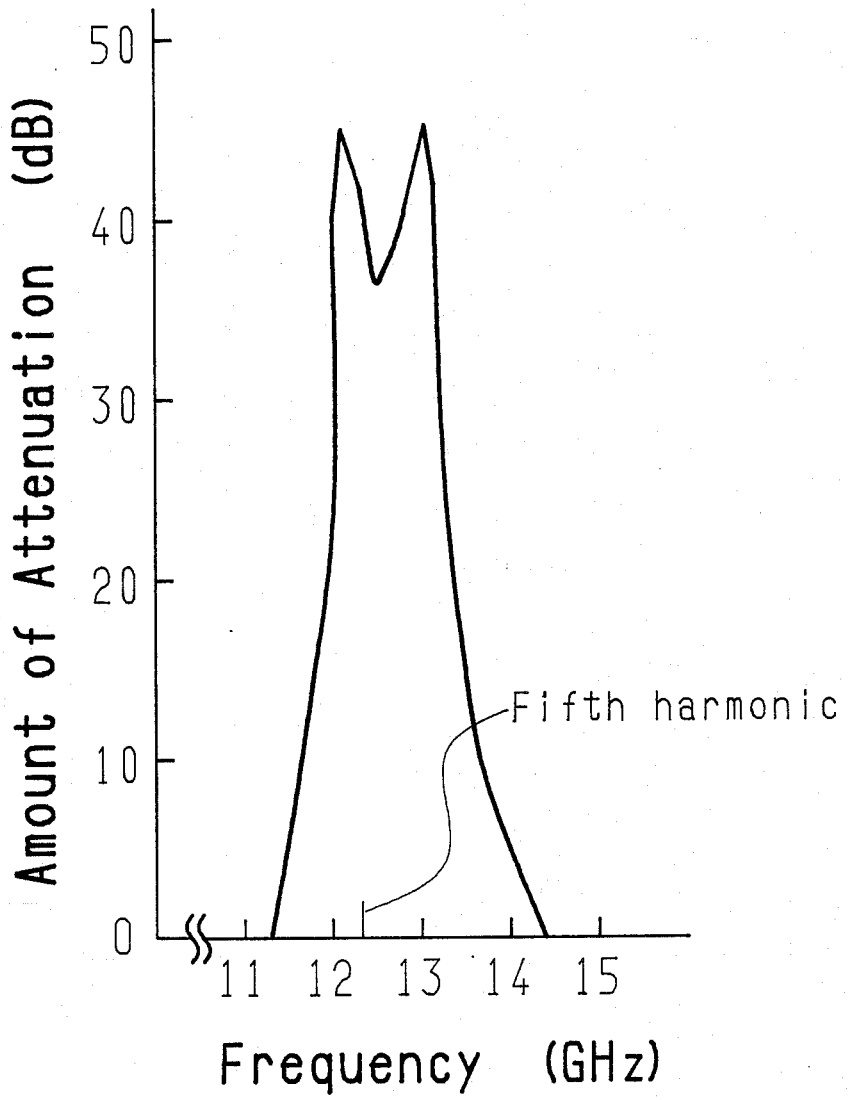
Figure 9:
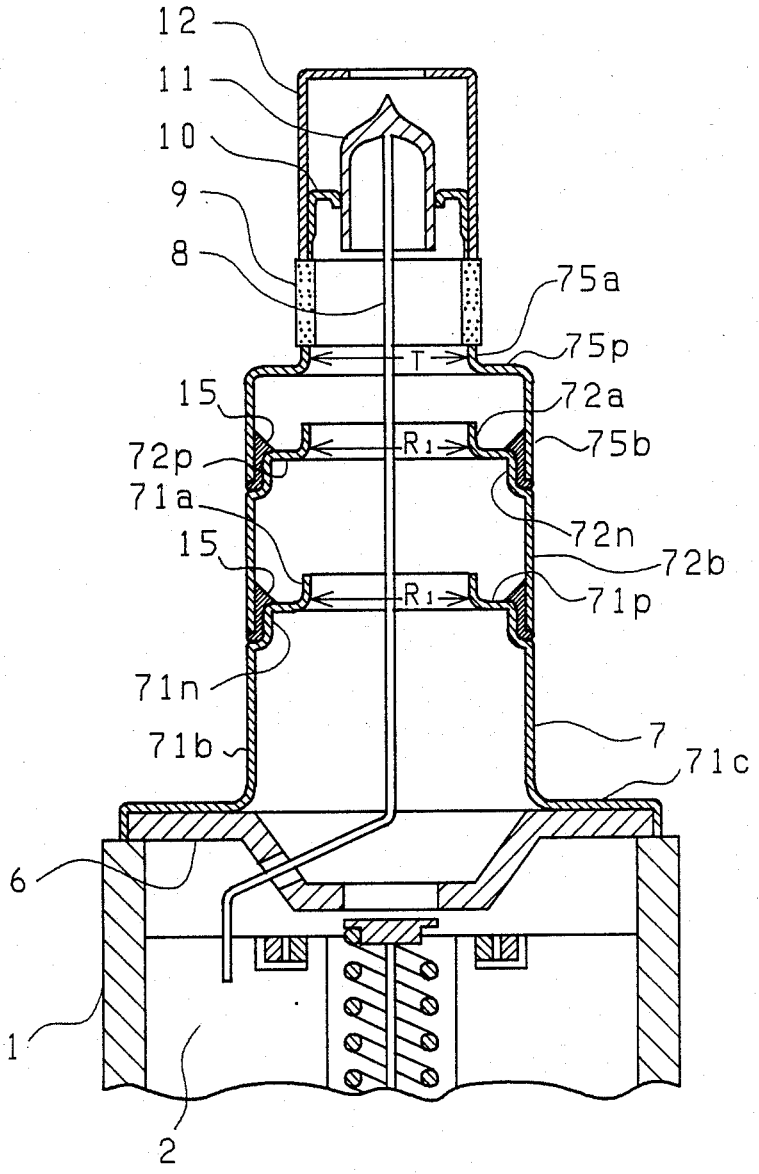

A space formed by a cylinder portion 71*a*, a stepped portion 71*p*, a cylinder portion 72*b* and a stepped portion 72*p*; and a space formed by a cylinder portion 72*a*, a stepped portion 72*p*, a cylinder portion 75*b*, a stepped portion 75*p* and a cylinder portion 75*a* can be made resonant with a particular wavelength to be suppressed by optimization of the dimensions as in FIG. 5. Two spaces can be made to be resonant with the same wavelength or two different wavelengths. If a difference in resonant wavelengths between two spaces is less than 1 GHz, suppression in a wider wavelength range can be obtained due to overlapping of attenuation around two wavelengths, therefore resonant wavelengths for two spaces has not necessarily to be the same as shown in FIG. 8. FIG. 9 shows another embodiment which uses the same sub-cylinders 72 and 75, making possible standardization of components.

Figure 10:
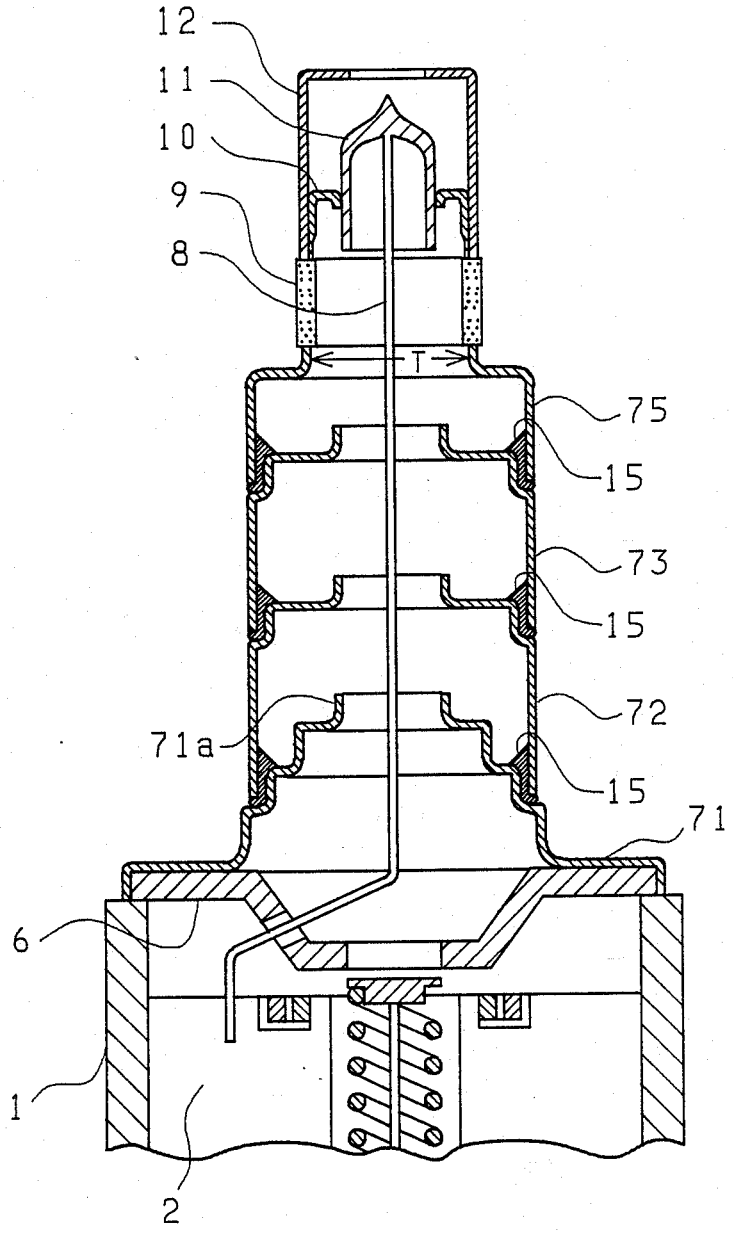

FIG. 10 shows another embodiment wherein a sub-cylinder 71 is provided with more stopped portions than in the previous embodiments in order to make a space formed by the sub-cylinder 71 and 72 resonant with a longer wavelength. The similar effect can be produced by forming more stepped portions in the sub-cylinders 72 instead of the sub-cylinder 71.

Figure 11:
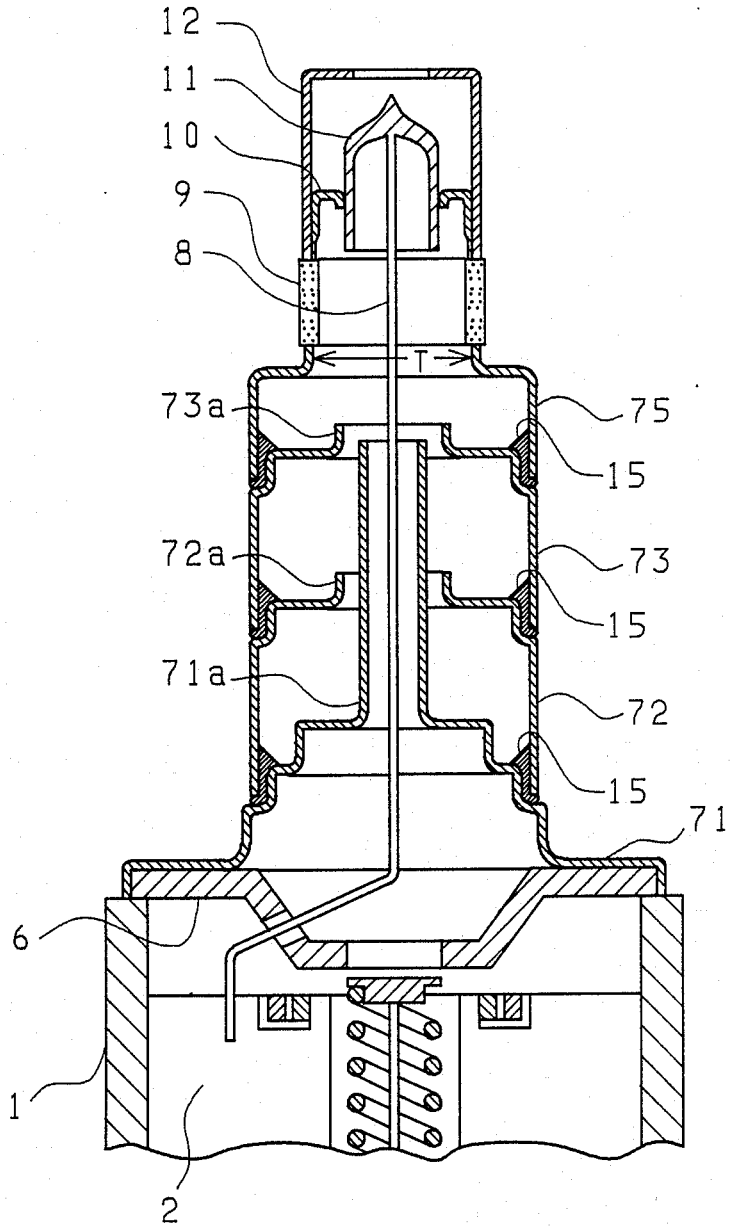
Figure 12:
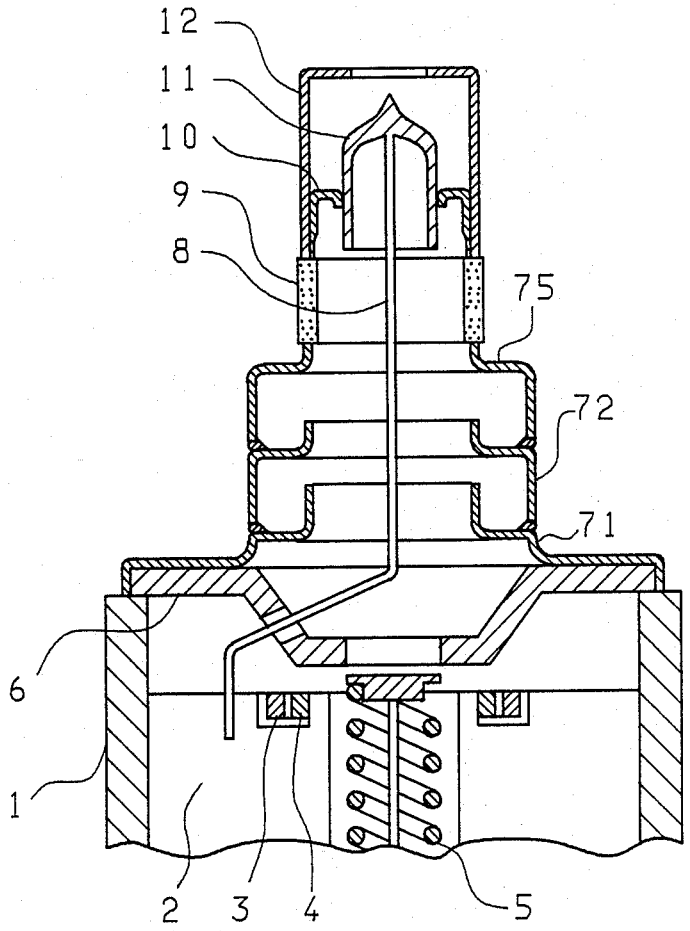

FIG. 11 shows another embodiment wherein the cylinder portion 71*a* of the lowermost sub-cylinder 71 passes through the cylinder portion 72*a* of the sub-cylinder 72 and extends into the cylinder portion 73*a* of the uppermost sub-cylinder 73 and a space formed by the sub-cylinders 71 and 72 can be resonant with a longer wavelength than in FIG. 10 and a space formed by sub-cylinders 71, 72, a space formed by sub-cylinders 72, 73, and a space formed by sub-cylinders 71, 72, 73 interact and produce suppression effect in wide-range wavelengths. A plurality of stepped portions can also be formed in the sub-cylinder 72 or 73, or both of them. In the embodiments shown in FIGS. 5, 7, 9, 10 and 11, positioning of sub-cylinders in their intended mutual relationship is made by inserting a stepped portion (71*n* in FIG. 5 for example) into the inside of the cylinder portion of an adjacent sub-cylinder without a jig. FIG. 12 shows another embodiment wherein a plurality of sub-cylinders 71, 72 and 75 are hermetically brazed with the end of a cylinder portion of a sub-cylinder abutting against the shoulder of an adjacent sub-cylinder without inserting a stepped portion into a cylinder portion, and the effect similar to the previous embodiments can be obtained.

As described above, the present invention provides a magnetron which can prevent leakage of electromagnetic waves of undesired wavelengths greatly and in wide wavelength range using a choke structure which is suitable for mass production, therefore a microwave oven incorporating a magnetron of the present invention can suppress leakage of undesired wavelengths by means of a magnetron only without increasing its cost.

What is claimed is:

1. A magnetron comprising an anode cylinder, vanes extending radially and inwardly from said anode cylinder, an output-side-sealing metal cylinder sealed to the end of said anode cylinder, an antenna lead connected to one of said vanes, and a plurality of flanged metal cylinders enclosing said antenna lead and disposed in axially spaced relationship inside said output-side sealing metal cylinder so as to define a plurality of non coaxial and axially spaced spaces along the direction of a magnetron tube axis whereby the spaces enclosed by said output-side-sealing cylinder and said respective flanged cylinders are resonant with a wavelength to be suppressed.

2. A magnetron comprising an anode cylinder, vanes extending radially and inwardly from said anode cylinder, an output-side-sealing metal cylinder sealed to the end of said anode cylinder to form an evacuated envelope in combination with said anode cylinder, an antenna lead connected to one of said vanes, said output-side sealing metal cylinder comprising a plurality of sub-cylinders stacked along the direction of the axis of the magnetron tube axis and hermetically sealed by brazing the end of a cylinder portion of said sub-cylinders on an adjacent sub-cylinder to form a plurality of spaces enclosed by said adjacent sub-cylinders, said space being disposed moncoaxially and in axially spaced and non-overlapping relationship and resonant with wavelengths to be suppressed.

3. A magnetron according to claim 1 wherein all of said spaces are resonant with the same wavelength.

4. A magnetron according to claim 1 wherein at least two of said spaces are resonant with different wavelengths.

5. A magnetron according to claim 2 wherein sub-cylinders are formed with a stepped portion.

6. A magnetron according to claim 5 wherein said stepped portion is inserted into the end of a cylinder portion of said adjacent sub-cylinder.

7. A magnetron according to claim 2 wherein said sub-cylinders are formed with a plurality of stepped portions.

8. A magnetron according to claim 2 wherein all of said spaces are resonant with the same wavelength.

9. A magnetron acdording to claim 2 wherein at least two of said spaces are resonant with different wavelengths.

* * * * *